United States Patent [19]

Allen

[11] Patent Number: 4,466,757

[45] Date of Patent: Aug. 21, 1984

[54] VIBRATORY SCREED INCLUDING A SPREADING DEVICE FOR LEVELING AND DISTRIBUTING PLASTIC CONCRETE IN FRONT OF THE SCREED

[75] Inventor: J. Dewayne Allen, Paragould, Ark.

[73] Assignee: Allen Engineering Corporation, Paragould, Ark.

[21] Appl. No.: 457,727

[22] Filed: Jan. 13, 1983

[51] Int. Cl.[3] ..... E01C 19/30

[52] U.S. Cl. ..... 404/114; 404/119

[58] Field of Search ..... 404/102, 101, 114, 119, 404/118

[56] References Cited

U.S. PATENT DOCUMENTS

| | | | |
|---|---|---|---|
| 2,583,108 | 1/1952 | Lewis | 94/44 |
| 3,110,234 | 11/1963 | Oster | 404/119 |
| 3,113,494 | 12/1963 | Barnes | 404/114 |
| 3,321,250 | 5/1967 | Truelock | 299/39 |
| 3,377,933 | 4/1968 | Dale | 94/45 |
| 4,320,987 | 3/1982 | Row et al. | 404/115 |
| 4,335,976 | 6/1982 | Morrison | 404/114 |

OTHER PUBLICATIONS

"Spring, 1982 CMI Corporation News" Brochure (Special Bid-Well Issue).

"Bid-Well Concrete Finishers-Bridge Decks.Slopes.-Slabs" Bottom of Page: Look to the Leader, 1978.

"M.9000 Multi-Directional Slipform Paver" Brochure-Another Performance by Miller Formless Systems & Miller Formless Introduces M1000, 1978.

*Primary Examiner*—Ernest R. Purser

*Assistant Examiner*—Mark J. DelSignore

*Attorney, Agent, or Firm*—Cahill, Sutton & Thomas

[57] ABSTRACT

A vibratory concrete screed includes a frame having first and second ends and a length equal to or greater than the width of plastic concrete to be finished. A screed blade is coupled to the screed frame and engages the full width of the plastic concrete. Vibration generating structure is coupled to the screed for vibrating the screed blade. A concrete spreading device is coupled to the screed frame to level the surface of the plastic concrete and to evenly distribute excess plastic concrete in front of the screed blade. The concrete spreading device includes a grading device having either an auger or a grading blade or both an auger and a grading blade. A carriage maintains the grading device at a desired relative elevation to the screed blade and translates the grading device back and forth along the length of the screed frame. The side to side translation of the grading device along the screed frame laterally distributes the excess concrete and displaces the concrete forward and away from the screed blade. Forward translation of the screed along the concrete forms together with the side to side translations of the carriage along the length of the screed frame levels and finishes the surface of the plastic concrete.

52 Claims, 31 Drawing Figures

FIG. 13
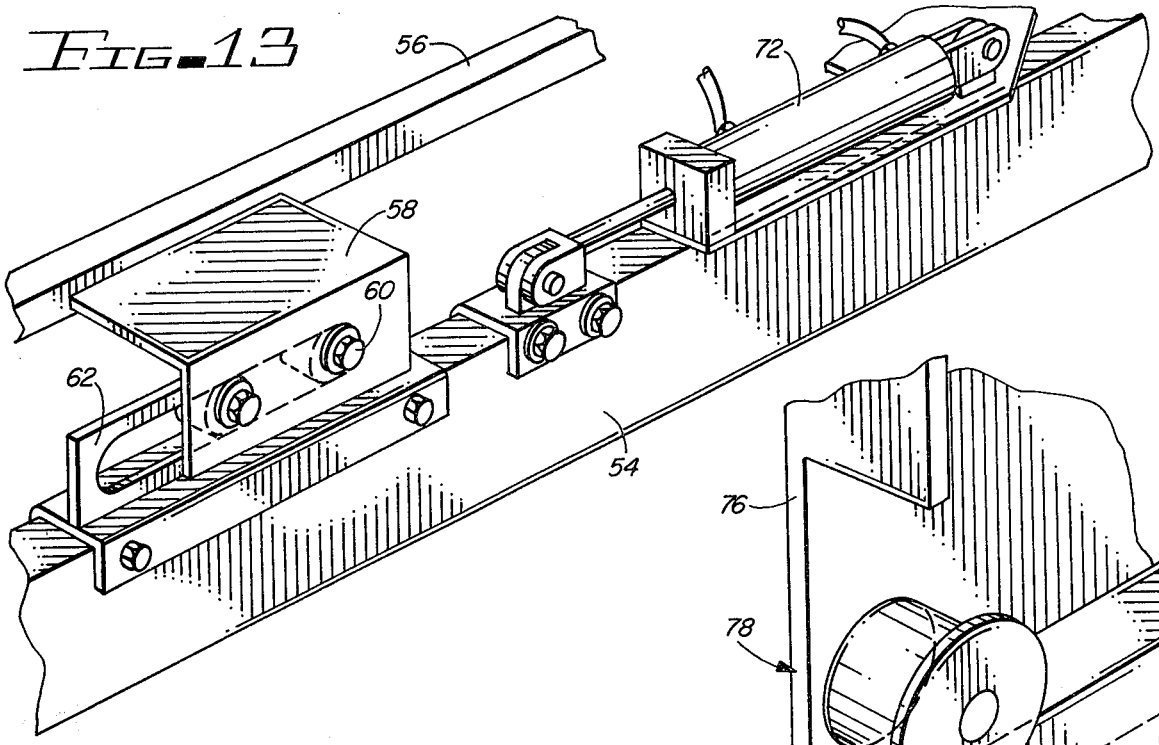
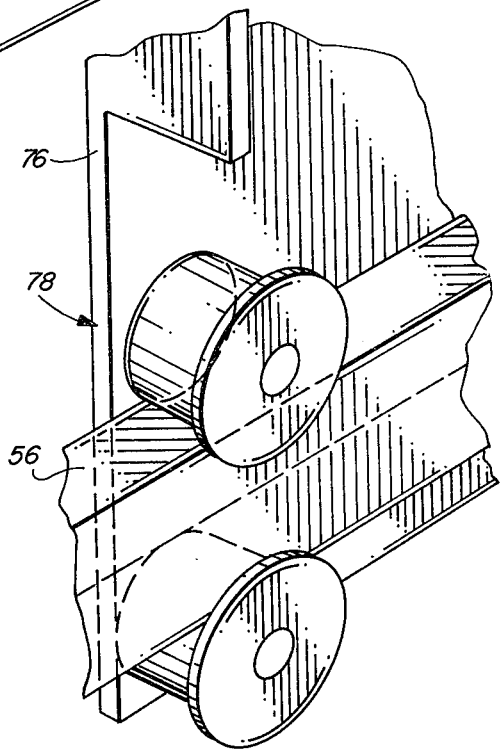
FIG. 14
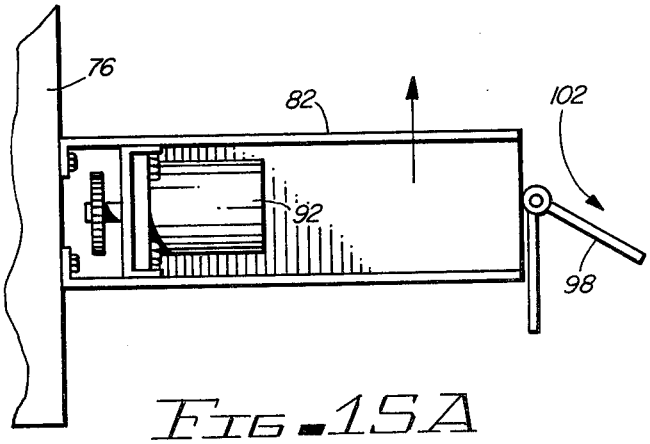
FIG. 15A
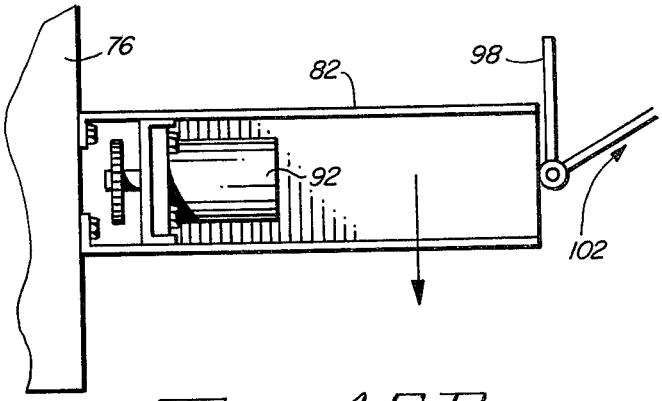
FIG. 15B

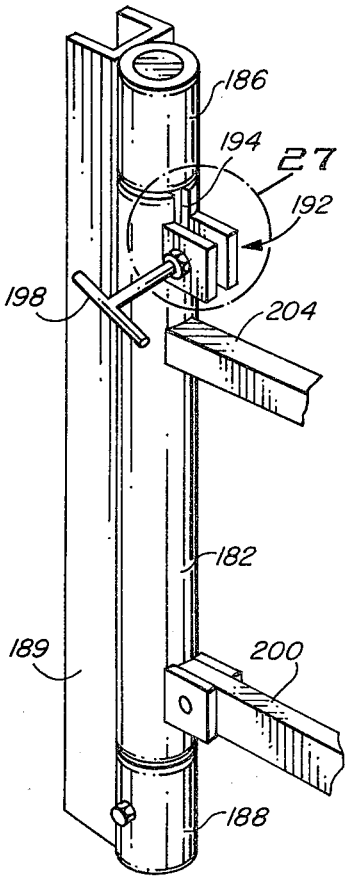
FIG. 26
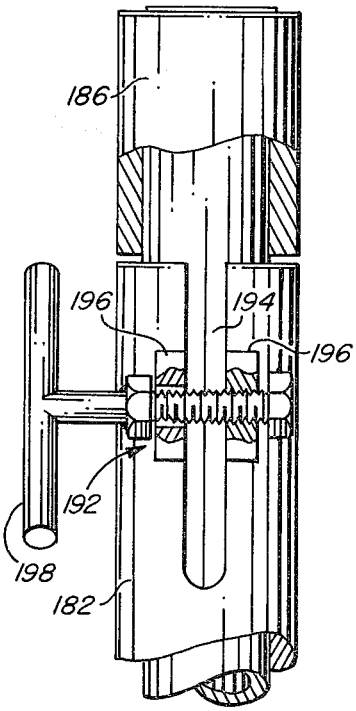
FIG. 27
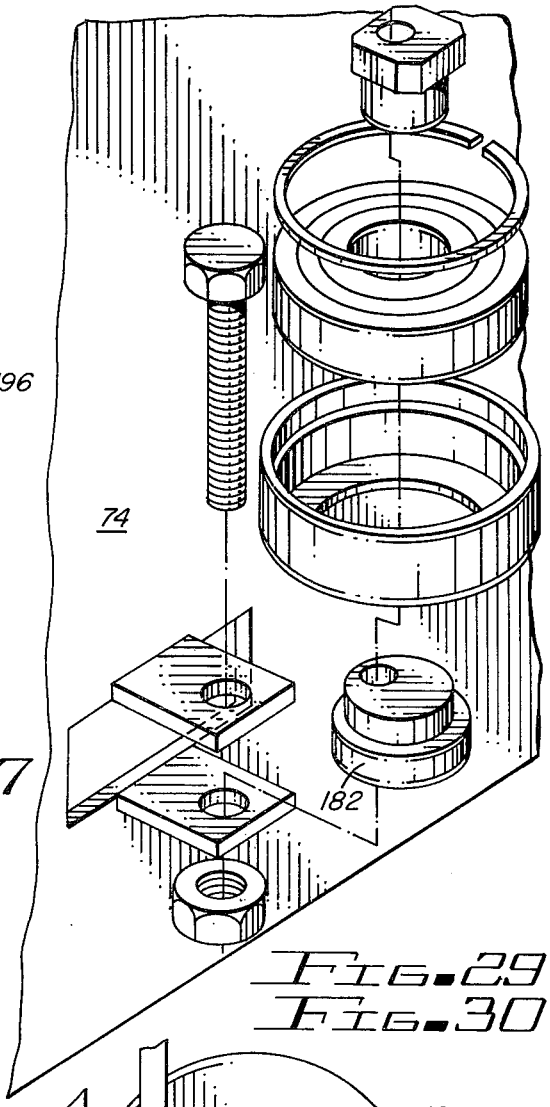
FIG. 29
FIG. 30
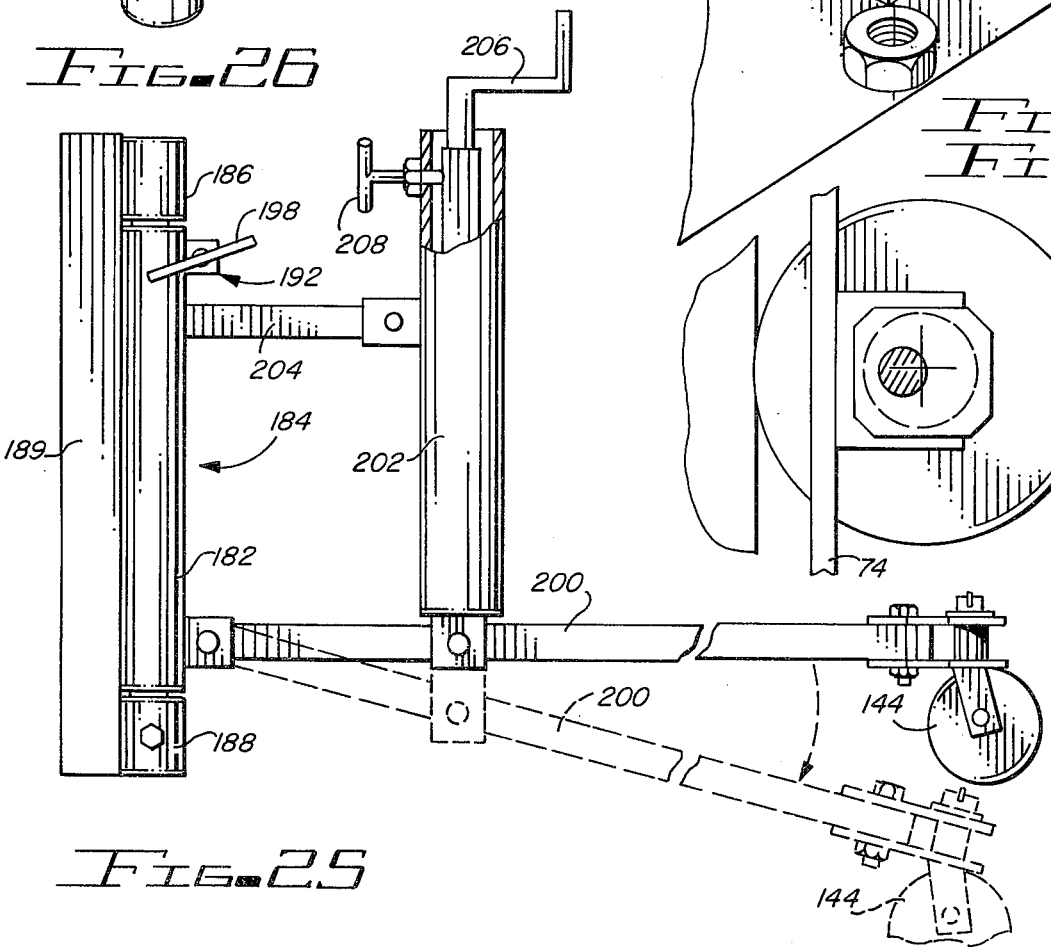
FIG. 25

VIBRATORY SCREED INCLUDING A SPREADING DEVICE FOR LEVELING AND DISTRIBUTING PLASTIC CONCRETE IN FRONT OF THE SCREED

BACKGROUND OF THE INVENTION

1. Field of the Invention

This invention relates to vibratory concrete screeds, and more particularly, to vibratory concrete screeds which include a laterally translatable concrete spreading device positioned in front of the screed blade for leveling and distributing plastic concrete before the screed blade engages the concrete.

2. Description of the Prior Art

A concrete screed is a device for simultaneously leveling and finishing the entire width of the surface of freshly poured plastic concrete. In order to achieve greater production rates, modern concrete screeds typically incorporate vibration generating mechanisms for vibrating the screed blade which actually engages, levels and finishes the upper surface of the concrete. Triangular truss concrete screeds incorporating spaced apart front and rear blades have become increasingly popular during the last few years for a number of reasons. A triangular truss screed is strong yet light and can be assembled in a variety of lengths from a plurality of separate, shorter length screed frame sections.

Concrete is typically poured between opposing side forms that also support the ends of the screed. Before the screed can be advanced into the area of freshly poured concrete, several workers with shovels must fill in any low places in the plastic concrete and must redistribute the concrete so that the screed blade will initially engage the plastic concrete surface only approximately slightly above the concrete surface. If the upper surface of the plastic concrete is not properly manually leveled and distributed, an excess amount of concrete will come in contact with the screed blade and will ultimately prevent further forward movement of the screed into the unfinished concrete. These manual prefinishing operations must be accomplished promptly to prevent premature setting of the freshly poured concrete before the screed finishing operation has been completed.

The Bid-Well Division of CMI Corporation of Canton, S. Dak. presently manufactures a spinning tube concrete finishing device that utilizes an elevated support bridge which spans the width of an unfinished concrete surface. See U.S. Pat. No. 4,320,987. A laterally translatable spinning tube finishing device is suspended beneath the elevated bridge and is translated from side to side beneath the bridge by an engine driven hydraulic system that engages and displaces a continuous chain. A large horizontally oriented dual-auger assembly is coupled to the front of the laterally translatable spinning tube finishing device. The two counter rotating augers engage the upper surface of the concrete and both level and distribute plastic concrete as the finishing unit is translated from side to side below the support bridge. After an out and back finishing pass has been completed, the support bridge is moved forward on the concrete side forms to reposition the spinning tube finishing rollers for the next out and back finishing pass. The Bid-Well roller finisher also may include a spud vibrator attachment which can be coupled to the laterally translatable finishing device in front of the auger to consolidate the plastic concrete before contact by the augers. The bridge is supported by four spaced apart corner roller assemblies. Each roller assembly includes a jacking device for independently adjusting each of the four corners of the support bridge. Each roller assembly can be positioned at a variable location along the length of the support bridge to permit the roller assemblies to engage concrete forms having variable spacing. Hydraulic motors drive rollers coupled to selected ones of the roller assemblies in order to translate the Bid-Well roller finisher along the concrete forms.

In the Bid-Well device, finishing is accomplished by interaction of the smooth rotating surface of the paired spinning tubes as they are laterally translated back and forth across the upper surface of the concrete. As explained above, a vibratory concrete screed utilizes either a single or two spaced apart vibrating blades to level and smoothly finish the upper surface of the plastic concrete. The screed is continuously advanced into the unfinished plastic concrete surface. The Bid-Well roller finisher accomplishes its finishing operation by laterally translating a pair of spaced apart spinning tubes beneath an elevated bridge deck while the bridge deck is maintained in a fixed position along the concrete side forms.

The Miller Formless Company of McHenry, Ill. manufactures a 30,000 pound directional paver machine which includes an oscillating screed blade and a variable height strike-off auger. This fixed position auger is oriented parallel to the oscillating screed blade. Rotation of the auger spreads concrete along the width of the screed blade.

U.S. Pat. No. 4,335,976 (Morrison) discloses a triangular truss screed having an engine driven vibratory shaft which extends along the entire length of the screed for imparting vibratory motion to the front and rear screed blades. Morrison further discloses a hydraulically powered winch system which incorporates a hydraulic pump which is belt driven by the rotary motion of the screed vibratory shaft. The two spaced apart hydraulic winches are therefore powered by a single internal combustion engine mounted on the screed frame.

U.S. Pat. No. 3,377,933 (Dale) discloses a winch propelled road laying machine having a reciprocating, rear-mounted screed and a front-mounted spreading auger which spans the distance between the concrete forms.

U.S. Pat. No. 2,583,108 (Lewis) discloses a concrete spreader having two spaced apart spreading augers mounted on a carriage and laterally translatable with respect to the machine frame. A vertical distributing plate is mounted on the carriage between the augers to laterally distribute plastic concrete.

Both the Dale and Lewis patents were cited as references against U.S. Pat. No. 4,320,987 referred to above.

SUMMARY OF THE INVENTION

It is therefore a primary object of the invention to provide a vibratory concrete screed including a concrete spreading device which translates a grading device back and forth along the length of the screed to level the irregular surface of the plastic concrete in front of the screed and to evenly distribute excess concrete in front of the screed before the screed blade engages the concrete surface.

Another object of the present invention is to provide a vibratory concrete screed which includes a laterally translatable concrete spreading device having a rotating auger.

Another object of the present invention is to provide a vibratory concrete screed which includes a laterally translatable concrete spreading device having a grading blade for leveling the irregular surface of the plastic concrete and for moving excess concrete forward and away from the screed blade as the grading blade is translated back and forth along the length of the screed.

Another object of the present invention is to provide a vibratory concrete screed including a concrete spreading device which substantially eliminates manual concrete distribution and leveling operations before advancing the screed into an area of freshly poured concrete.

Another object of the present invention is to provide a vibratory concrete screed which is capable of receiving an oscillating strikeoff between the concrete spreading device and the screed blade for further finishing and compacting the plastic concrete before engagement by the screed blade.

Another object of the present invention is to provide a vibratory concrete screed including a screed guide device coupled to each end of the screed frame for maintaining the screed centered between opposing concrete forms, wherein each end of the screed guide device includes wheel units having independently adjustable tracking widths.

Another object of the present invention is to provide a vibratory concrete screed which includes a screed guide device having height adjustment means for permitting the screed to be elevated and rolled back over an area of finished concrete without disturbing the surface of the concrete.

Another object of the present invention is to provide a vibratory concrete screed having a concrete spreading device which can utilize a conventional triangular truss vibratory screed having spaced apart front and rear screed blades as the primary structural support element for the concrete spreading device.

Another object of the present invention is to provide a vibratory concrete screed having a concrete spreading device which incorporates a self-contained hydraulic power system.

Briefly stated, and in accord with one embodiment of the invention, a vibratory concrete screed includes a frame having first and second ends and a length equal to or greater than the width of a plastic concrete surface. A screed blade is coupled to the screed frame and engages the full width of the plastic concrete. Vibrating means is coupled to the screed for vibrating the screed blade. The screed further includes concrete spreading means which is coupled to the screed frame for leveling the surface of the plastic concrete and for evenly distributing plastic concrete in front of the screed. The concrete spreading means includes grading and carriage means. The carriage means maintains the grading means at a desired position in front of the screed frame and translates the grading means back and forth along the length of the screed frame. Forward translation of the screed along concrete side forms together with side to side translations of the grading means along the length of the screed frame levels and finishes the surface of the plastic concrete The screed may include screed guide means having first and second units coupled to the first and second ends of the screed. In one embodiment, the screed guide means enables the entire screed to be supported by and elevated above the concrete forms such that the screed can be rolled back on the forms over an area of finished concrete without disturbing the surface of the concrete. In another embodiment, the screed guide means includes first and second units coupled to the first and second ends of the screed for maintaining the screed in alignment with the concrete forms as the screed is moved forward along the concrete forms. Each end of the screed guide means includes first and second spaced apart wheel units. Each wheel unit includes a laterally adjustable roller which engages the concrete form.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

FIG. 13 is a partially cutaway perspective view of a pneumatically powered version of the oscillating strikeoff attachment for the vibratory concrete screed of the present invention.

FIG. 14 is a partially cutaway perspective view particularly illustrating the manner in which the carriage is coupled to the screed frame.

FIGS. 15A and B are partially cutaway plan views of the carriage depicting the manner in which the concrete grading blade is repositioned between the first and second trailing positions as a result of reversal of the direction of travel of the concrete spreading device.

FIG. 25 is a partially cutaway elevational view of the end support structure of the screed depicted in FIG. 24, particularly illustrating the manner in which the screed guide unit can be vertically adjusted.

FIG. 26 is an enlarged, partially cutaway perspective view of the end support member hinge structure depicted in FIG. 25.

FIG. 27 is a partially cutaway, enlarged view of the hinge clamp depicted in FIG. 26.

FIG. 29 is an exploded perspective view of the lateral adjustment device for the horizontally oriented roller depicted in FIG. 28.

FIG. 30 is a simplified view from above of the horizontally oriented roller support structure depicted in FIG. 28.

DESCRIPTION OF THE PREFERRED EMBODIMENT

In order to better illustrate the advantages of the invention and its contributions to the art, a preferred hardware embodiment of the invention will now be described in some detail.

Figure 1:
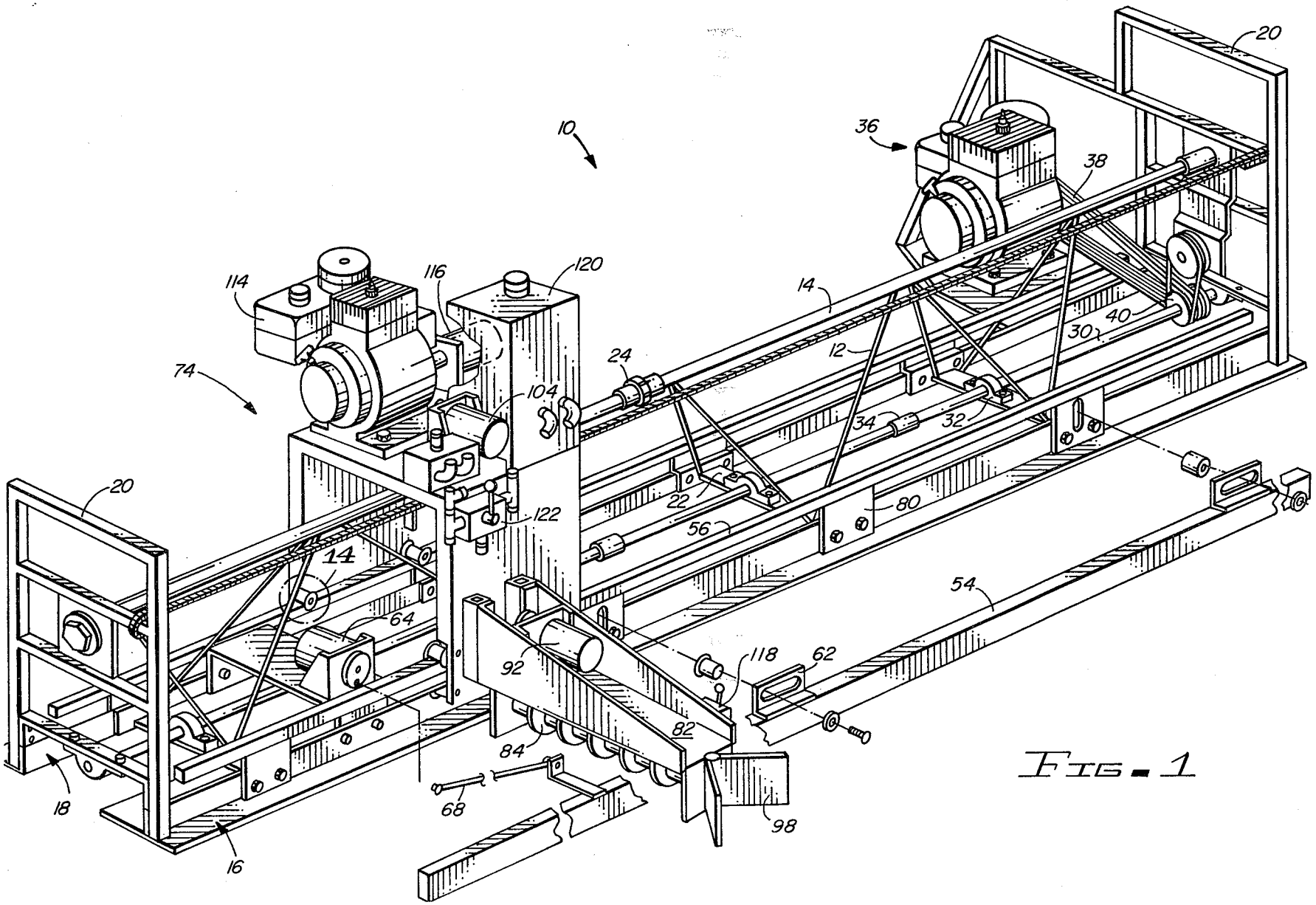
FIG 1 is a partial perspective view of the primary structural elements of the vibratory concrete screed of the present invention. For the purpose of clarity, several subsidiary structures of the screed are not depicted in FIG. 1.
Figure 2:
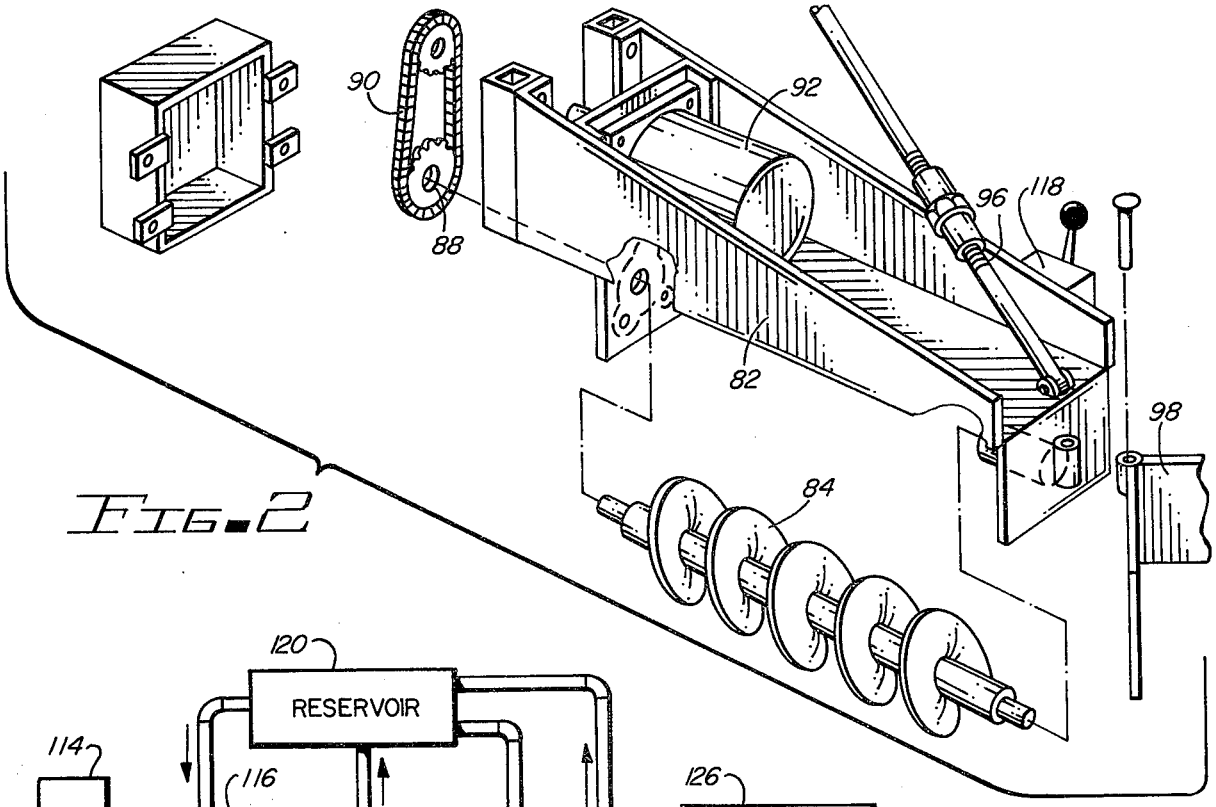
FIG. 2 is an exploded perspective view of the primary elements of the auger and auger drive assembly.
Figure 11:
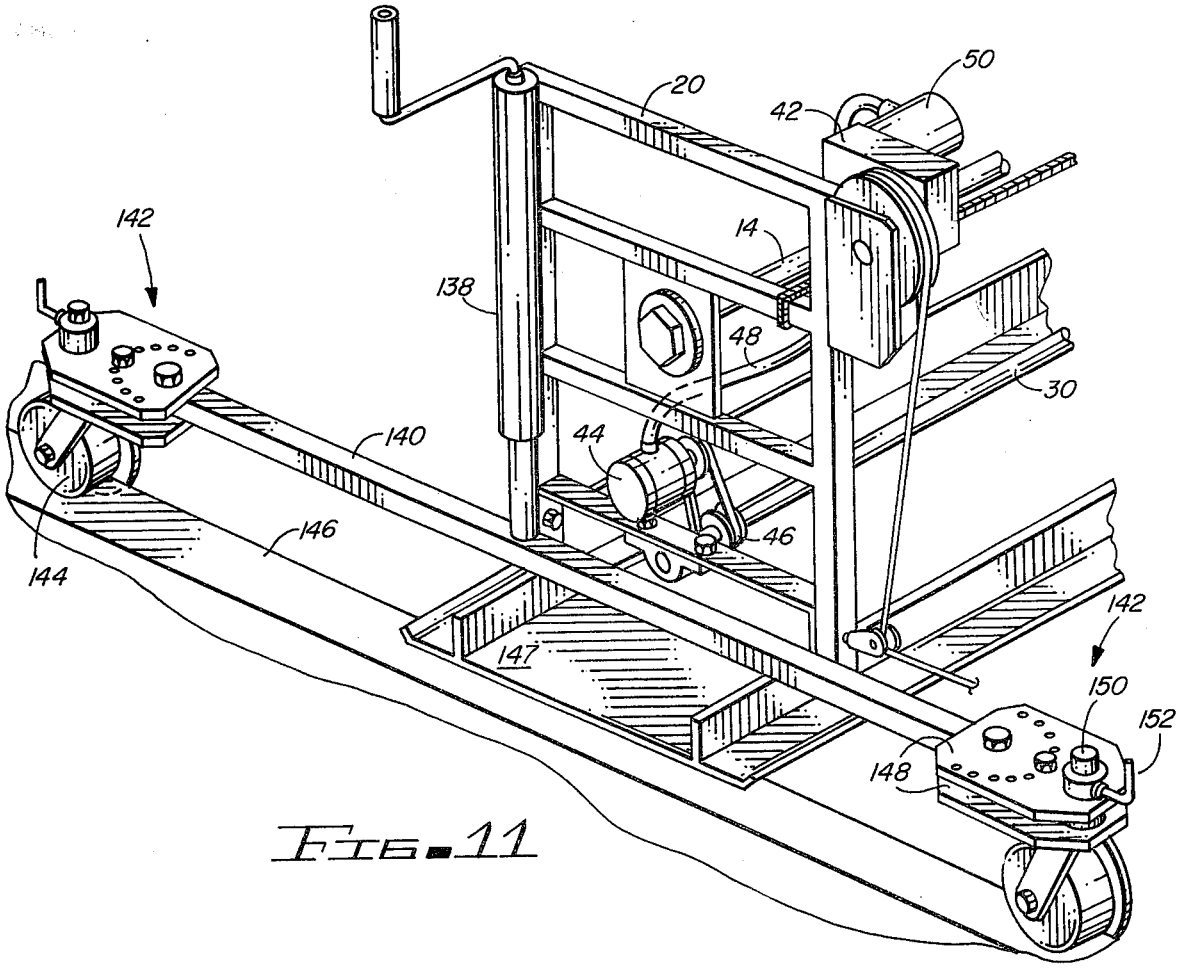
FIG. 11 is an enlarged perspective view of one end of the vibratory concrete screed of the present invention, particularly illustrating the winch and its hydraulic power system and the screed guide means.

Referring to FIGS. 1, 2 and 11, the major operative elements of the invention will initially be discussed. Concrete screed 10 includes a triangular truss frame fabricated from a plurality of metal struts 12, a horizontally oriented top pipe 14 and front and rear screed blades 16 and 18. A vertically oriented end bracket 20 includes front and rear legs which are bolted respectively to front screed blade 16 and rear screed blade 18 and a center bracket section which is secured to an end of top pipe 14. A plurality of horizontally oriented lower frame elements, such as frame element 22, are oriented perpendicular to and span the distance between front and rear screed blades 16 and 18. A screed truss design of this type is well known to one of ordinary skill in the art. A triangular truss screed is typically fabricated by joining together a plurality of screed frame sections and blade sections to produce a screed having the desired total length for a particular application.

Figure 10:
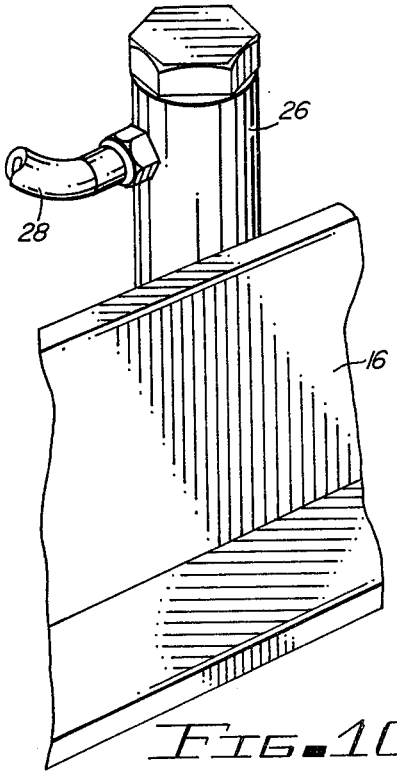
FIGS. 10 illustrates the utilization of a pneumatically powered vibrator for imparting vibratory motion to the screed blades.

A top pipe coupler unit 24 joins together adjacent screed frame sections. Adjustment of this turnbuckle-like device bows the screed frame and blades to permit the contour imparted to the upper surface of the plastic concrete to be controlled to produce crowned, inverted or other desirable surface contours. In the embodiment of the present invention in which a pneumatic vibrator 26 of the type depicted in FIG. 10 is utilized, top pipe 14 also serves as a sealed conduit to distribute pressurized air along the length of the screed. A plurality of air hoses, such as air hose 28, are coupled at one end to each pneumatic vibrator 26 and at the other end to top pipe 14. Highly efficient and durable pneumatically powered vibrators of an appropriate type are commercially available from the Allen Engineering Corporation of Paragould, Ark. Top pipe 14 may also provide a source of pressurized air for actuating pneumatically powered winches which may be coupled to end brackets 20.

In the engine driven embodiment of the invention illustrated in FIG. 1, a drive shaft 30 extends along the entire length of screed 10 and is rotatably coupled to a plurality of frame elements 22 by a series of spaced apart bearing blocks, such as bearing block 32. Eccentric weights, such as eccentric weight 34, are coupled at spaced apart intervals to drive shaft 30 such that high speed rotation of drive shaft 30 causes a comparatively high frequency, controlled vibration to be transmitted to screed blade assemblies 16 and 18. In the embodiment depicted in FIG. 1, a gasoline engine 36 is coupled to a plurality of "V"-belts 38 and to a corresponding series of drive pulleys 40 to rotate drive shaft 30. In the preferred embodiment of the invention, an eight horsepower Briggs and Stratton engine is used.

Figure 16:
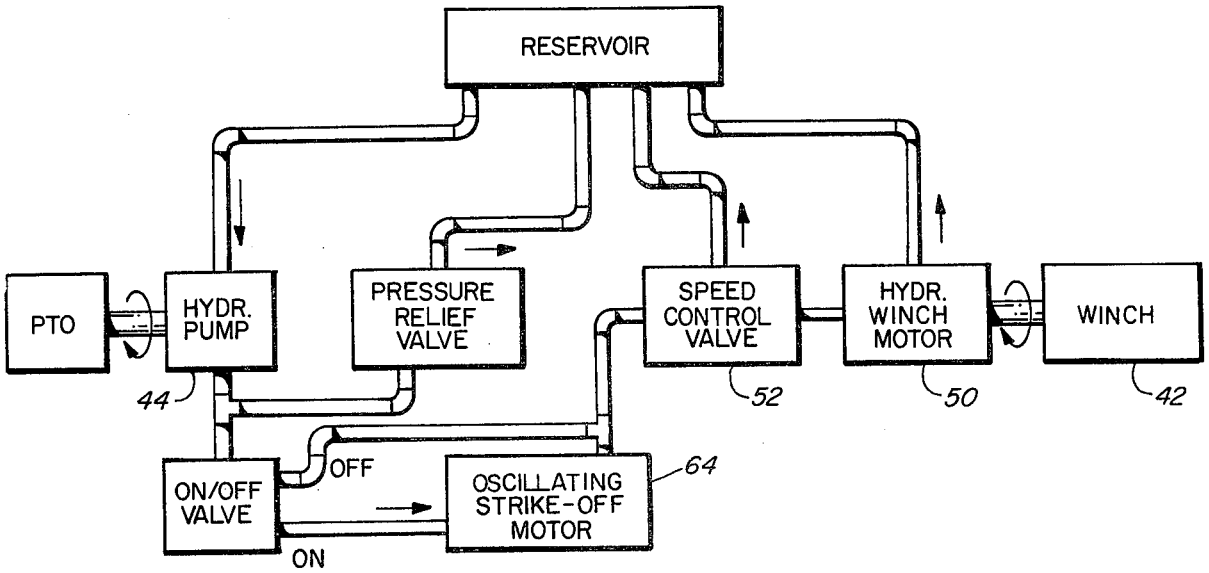
FIG. 16 is a schematic diagram representation of the self-contained hydraulic system of the oscillating strikeoff attachment.

Referring now to FIGS. 1 and 11, a hydraulically powered winch embodiment of the screed translation means will be described in detail. The power take-off system for driving a hydraulic pump 44 includes a pulley 46 which is coupled to shaft 30. A "V"-belt and pulley couples the rotary motion of pulley 46 to hydraulic pump 44. The pressurized hydraulic fluid produced by hydraulic pump 44 is coupled by hose 48 to a hydraulic motor 50 which powers winch 42. FIG. 16 schematically depicts the various elements of the hydraulic winch system described above. Although not specifically illustrated in FIG. 11, a speed control valve 52 controls the volume of of pressurized hydraulic fluid through winch motor 50 to thereby control the translation velocity imparted to one end of the concrete screed by winch 42. A substantially identical independently powered hydraulic system is coupled to the opposite end of screed 10 in order to translate that end at a desired speed.

Although the hydraulically powered translation system discussed above in connection with FIG. 11 incorporates two separate hydraulic systems, a single hydraulic pump 44 could be coupled to screed end bracket 20 opposite to the end bracket to which hydraulic pump 44 is coupled. A separate speed control valve 52 for each winch hydraulic motor 50 could be coupled to a single end bracket 20 to permit one operator to independently control the translation speed of each end of the screed from a single location. Alternatively, the second speed control valve 52 could be coupled to the opposite end bracket 20 to permit a second operator to control the translation velocity of the second end. Any one of the various alternatives discussed above could be readily implemented on the present invention by one of ordinary skill in the art.

Referring now to FIGS. 1 and 13, an oscillating strike-off attachment 54 can readily be coupled to the screed frame of the present invention. The oscillating strike-off is reciprocated in the horizontal plane over a distance of approximately four to six inches for the purpose of smoothing and consolidating the plastic concrete before engagement by the front screed blade 16. In order to accomodate the oscillating strike-off 54, the forward extending "L"-shaped half of front screed blade assembly 16 must be removed, leaving the rear blade element of front screed blade assembly 16 to accomplish the initial screeding operation on the surface of the plastic concrete. FIG. 13 best illustrates the manner in which oscillating strike-off 54 is coupled to horizontally oriented track 56 by a pair of "L"-shaped brackets 58. A pair of spaced apart bolt and ball bearing support elements 60 permit reciprocating translation of oscillating strike-off 54 with respect to bracket 58. Both FIGS. 1 and 13 depict the manner in which a vertically oriented bracket 62 is coupled to the upper surface of oscillating strike-off 54 and includes an elongated aperture which engages support element 60.

Figure 4:
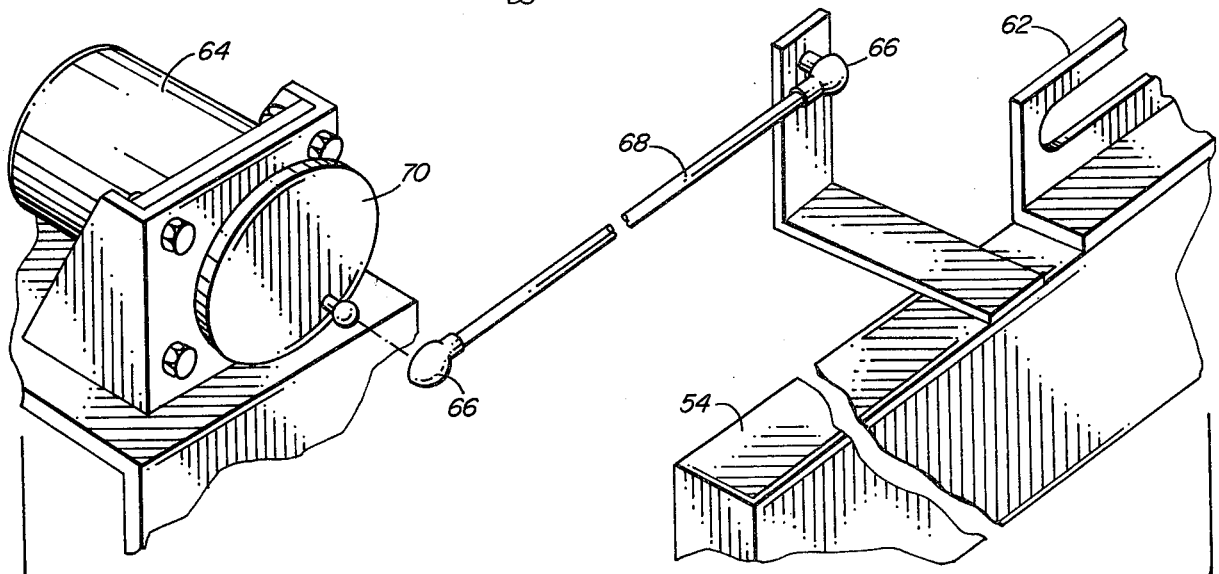
FIG. 4 is a partial perspective view showing the manner in which a hydraulic motor is coupled to the oscillating strikeoff attachment of the present invention to reciprocate the oscillating strikeoff.

In the vibratory screed depicted in FIG. 1 and 4, strike-off 54 is driven by a hydraulic motor 64. A ball and socket coupling unit 66 is positioned at each end of connecting rod 68 and serves to convert the rotating motion of output pulley 70 of hydraulic motor 60 into reciprocating motion of oscillating strike-off 54. The hydraulic system diagram depicted in FIG. 16 illustrates the manner in which oscillating strike-off motor 64 is coupled to a nearby hydraulic pump 44 which also powers a winch 50.

FIG. 13 illustrates a slightly different embodiment of oscillating strike-off 54 which may be incorporated on a pneumatically powered vibratory screed. In this embodiment, a dual action pneumatic cylinder 72 alternatively extends and retracts its output shaft to impart the desired reciprocating motion to strike-off 54. A pair of limit switches (not shown) change the air flow to pneumatic cylinder 72 when strike-off 54 has been displaced to the desired maximum and minimum extension points.

Figure 17:
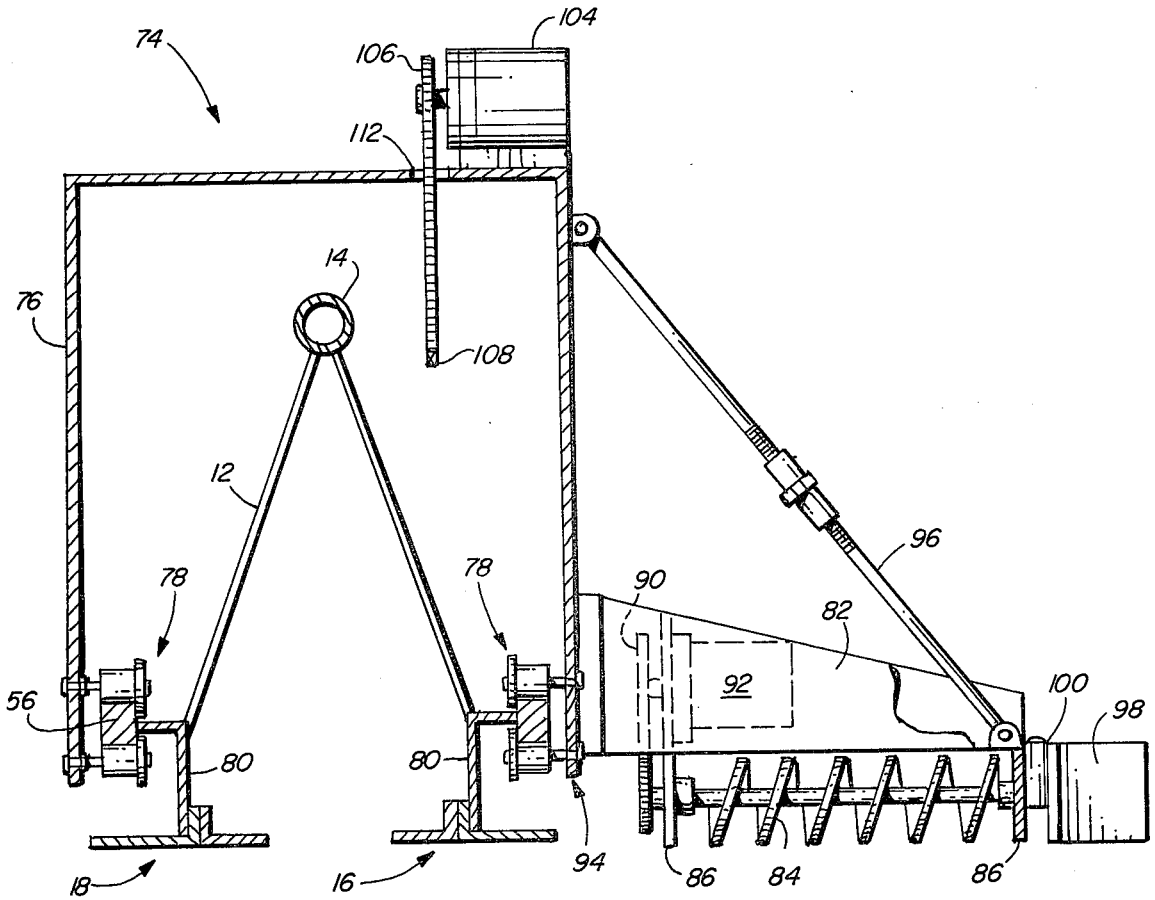
FIG. 17 is a partially cutaway sectional view of the vibratory concrete screed of the present invention.

Referring now to FIGS. 1, 2 and 17, the concrete spreading means or device for the concrete screed will now be described in detail. The primary structural element of concrete spreading device 74 comprises an inverted "U"-shaped steel bracket 76 which forms a part of the carriage means of the present invention. A plurality of four paired roller assemblies are coupled to the lower left and right ends of the front and rear sides of bracket 76. The roller elements of roller assemblies 78 surround and engage a horizontally oriented track 56 which is coupled to and supported above front and rear screed assemblies 16 and 18 by a plurality of vertically oriented supports 80. The spacing between the upper and lower rollers of roller assembly 78 is such that only either the upper roller assembly or the lower roller assembly contacts track 56. The lower roller elements of roller assemblies are provided to prevent bracket 76 from tilting away from track 56 as a result of a load or force imbalance. FIG. 14 depicts a substantially enlarged view of a single roller assembly 78.

Grading means in the form of either an auger or a grading blade or both an auger and a grading blade is coupled to and laterally translated by the carriage means. An embodiment of the grading means which includes both an auger and a grading blade will now be described in detail.

An auger support bracket 82 extends laterally out from the lower, front side of carriage means bracket 76. A horizontally oriented auger 84 is rotatably coupled to bracket 82 by vertically oriented auger mounting brackets 86. A sprocket wheel 88 is coupled to the protruding end of the shaft of auger 84 and engages a drive chain 90 which is coupled to and rotated by a hydraulic motor 92. The FIG. 3 schematic diagram of the concrete spreading device illustrates that hydraulic fluid flows in a single direction and at a constant rate through auger motor 92. The rotating auger engages the irregular upper surface of the plastic concrete, distributes and levels the concrete and displaces excess concrete forward and away from front screed blade assembly 16.

In the preferred embodiment of the invention, auger support bracket 82 is coupled only at its lower interior surface to the lower front surface of bracket 76 at approximately the point indicated by reference number 94. A turnbuckle assembly 96 is coupled at one end to the upper central surface of bracket 76 and at the opposite end to the outermost extension of auger support bracket 82. Turnbuckle assembly 96 permits the elevation of the outermost portion of auger 84 to be adjusted with respect to the elevation of front screed blade assembly 16. It has been found that for plastic concrete having a typical slump that the outer end of auger 84 should be adjusted to an elevation of approximately ¼ inch below the lower surface of front screed blade assembly 16. For unusually stiff, low slump concrete, the elevation of the outer end of auger 84 may be adjusted to be approximately equal to the elevation of the lower surface of front screed blade assembly 16. In a less complex embodiment of the present invention, turnbuckle assembly 96 may be eliminated and the innermost surface of auger support bracket 82 rigidly coupled to bracket 76.

A pivoting grading blade or plow 98 is coupled by a vertically oriented hinge 100 to the outer end of auger support bracket 82. As indicated in FIGS. 15A and B, grading blade 98 reverses direction as a function of the direction of travel of concrete spreading device 74. Arrows 102 in FIG. 15 illustrate the manner in which excess plastic concrete is deflected or displaced away from the concrete screed as a result of the operation of grading blade 98. Grading blade 98 partially levels the irregular upper surface of the plastic concrete and assists in laterally distributing the excess concrete to produce a more nearly level surface before engagement by auger 84.

Although grading blade 98 may be eliminated from certain embodiments of the present invention, substantially increased speed, efficiency and improved operation of the present invention is realized if a grading blade is utilized.

Figure 5:
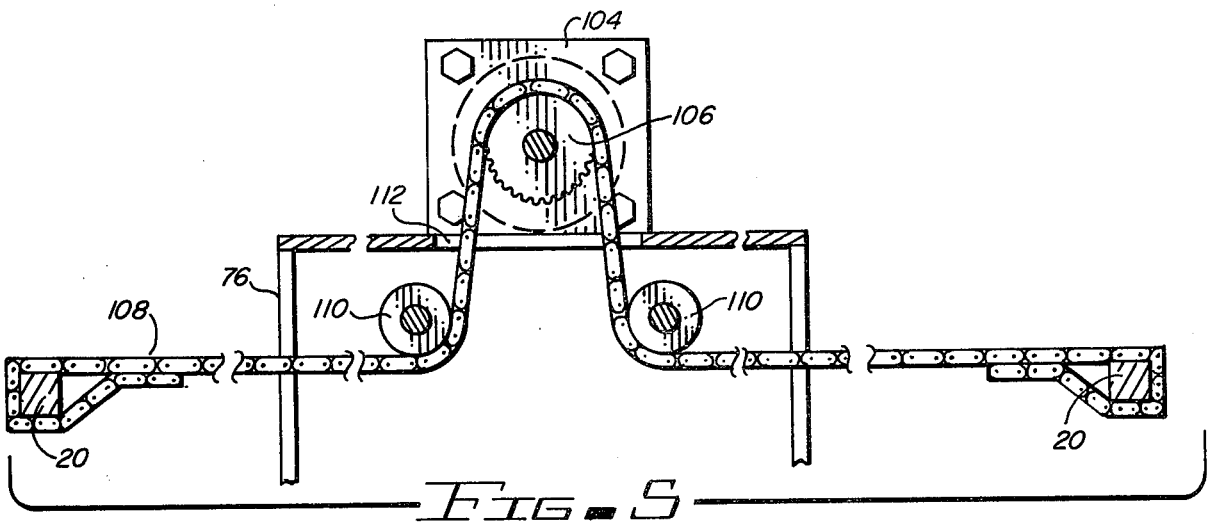
FIG. 5 is a partially cutaway, elevational view indicating the manner in which the hydraulic drive motor for the carriage is coupled to the frame of the concrete screed.

FIGS. 5 and 17 best illustrate the components which translate the concrete spreading device 74 back and forth along the length of concrete screed 10. A hydraulic motor 104 rotates a sprocket wheel 106. Sprocket wheel 106 engages a chain 108 that is rigidly coupled at each end to a horizontally oriented strut of each end bracket 20. A pair of pulleys 110 are coupled to bracket 76 and serve both to redirect chain 108 around sprocket wheel 106 and to maintain an appropriate amount of tension in chain 108. Chain 108 passes around pulleys 110 and extends through an aperture 112 in the upper surface of bracket 76.

Figure 3:
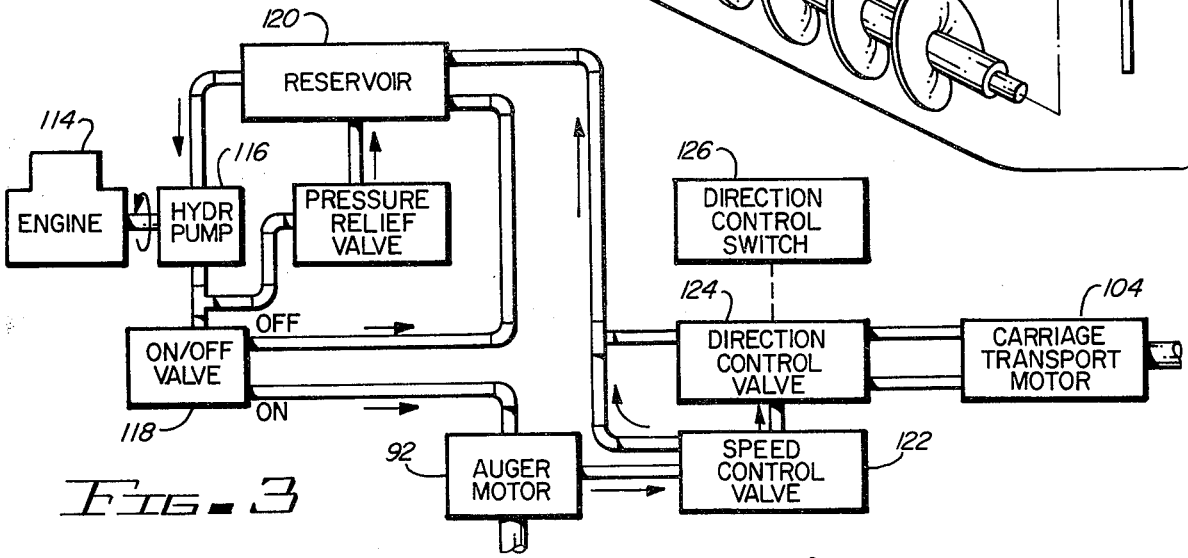
FIG. 3 is a schematic diagram representation of the hydraulic system of the concrete spreading device.

Referring now to FIGS. 1 and 3, the structure and operation of the self-contained hydraulic system for concrete spreading device 74 will be described in detail. A standard air cooled gasoline engine 114, such as an 8HP Briggs and Stratton engine, is coupled to drive hydraulic pump 116. On/off valve 118 is coupled to a front side surface of auger support bracket 82 and permits an operator of the vibratory concrete screed to either activate or deactivate auger motor 92 and carriage transport motor 104. In the "off" position, valve 118 directs hydraulic fluid from pump 116 back into an unpressurized hydraulic reservoir 120. In the "on" position, pressurized hydraulic fluid is directed from hydraulic pump 116 through auger motor 92 and speed control valve 122 to direction control valve 124. Speed control valve 122 is an automatic compensating flow control valve which regulates the volumetric flow of hydraulic fluid to carriage transport motor 104 to maintain a constant fluid flow through that motor at varying hydraulic pressures. This constant fluid flow rate maintains a constant carriage velocity as the load on gasoline engine 114 varies. A model FC-51 flow control valve manufactured by Brand Hydraulics Company of Omaha, Nebr. readily accomplishes this function. A flow control lever on speed control valve 122 determines the volume of hydraulic fluid which is directed into direction control valve 124. Excess hydraulic fluid is routed by speed control valve 122 directly into hydraulic fluid reservoir 120.

Direction control valve 124 determines the direction of hydraulic fluid flow through carriage transport motor 104. Direction control valve 124 is a commercially available product manufactured by Eaton Corporation Fluid Power Operations (Minnesota Division) of Eaton Prairie, Minn. A mechanical direction control switch 126 provides the direction input signal to direction control valve 124. Direction control switch 126 is mechanically coupled to direction control valve 124.

Figure 6:
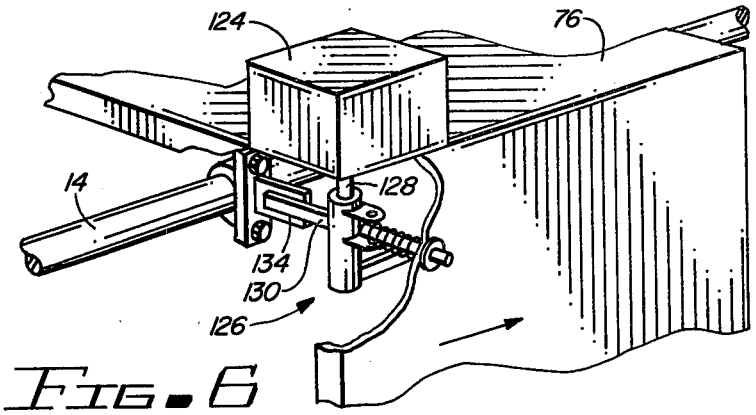
FIGS. 6–9 comprise a series of illustrations depicting the structure and operation of the carriage directional control switch.
Figure 7:
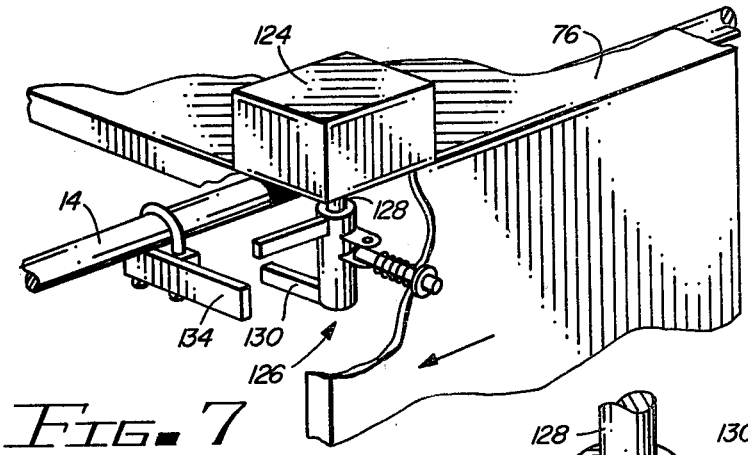
Figure 8:
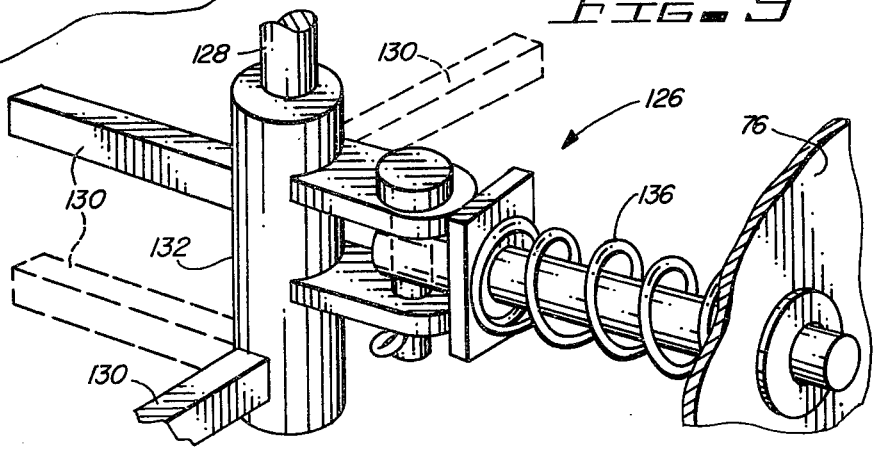

The structure and operation of direction control switch 126 will now be described in detail by referring to FIGS. 6–9. Direction control switch 126 is mechanically coupled to the actuator shaft 128 of direction control valve 124. Direction control switch 126 includes first and second horizontally oriented vertically offset sensing arms which are designated by reference number 130. These two sensing arms are coupled to a vertically oriented central support member 132 with a 90° offset. A stop bracket 134 is coupled as indicated in FIG. 7 to top pipe 14 at a selected lateral position such that the direction of travel of the concrete spreading device 74 will be changed at approximately the point where auger 84 approaches a concrete form. FIG. 6 illustrates a stop bracket 134 having different vertical offset from the stop bracket depicted in FIG. 7. This stop bracket actuates direction control switch 126 when the concrete spreading device 74 is travelling in the opposite direction.

Translation of one of the sensing arms of direction control switch 126 against stop bracket 134 causes actuator shaft 128 to be rotated 90°. This mechanical 90° rotation of direction control switch 126 actuates direction control valve 124 to reverse the flow of hydraulic fluid to carriage transport motor 104. Reversal of hydraulic flow through carriage transport motor 104 causes the direction of travel of concrete spreading device 74 to be reversed. The point at which this direction reversal takes place can be adjusted by coupling stop brackets 134 at a desired location to top pipe 14.

Figure 9:
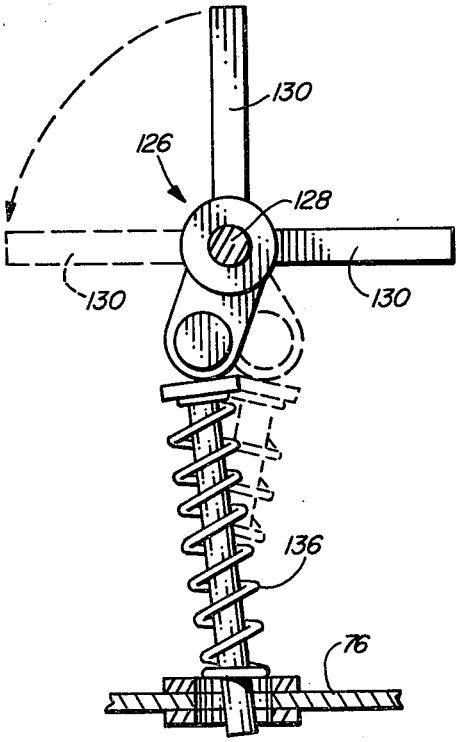

FIG. 9 best illustrates the manner in which the spring biasing structure designated by reference number 136 maintains direction control switch 126 in a predetermined fixed position once it has been actuated by a stop bracket 134.

In operation, the concrete screed of the present invention is typically translated in a forward direction into an area of unfinished concrete at a rate such that concrete spreading device 74 will pass over each section of unfinished plastic concrete two times before that section of concrete is contacted by the front screed blade assembly 16. The forward translation velocity of the screed can be adjusted in the hydraulically powered winch version by adjusting speed control valve 52. The lateral or side to side translation velocity of concrete spreading device 74 can be adjusted by speed control valve 122. A typical maximum lateral translation velocity for concrete spreading device 74 should be about 150 feet per minute.

Concrete spreading device 74 virtually eliminates the extensive manual labor which was formerly required to evenly distribute plastic concrete in front of the screed and to level the upper surface of the concrete such that the upper surface was approximately even with or slightly higher than the front screed blade assembly 16. The operation of auger 84 and the surprisingly cooperative function of grading blade 98 performs all of the preliminary concrete distributing and leveling operations previously accomplished manually with a far greater degree of precision and at a substantially faster rate resulting in significant cost savings and significantly shorter job completion times.

Figure 18:
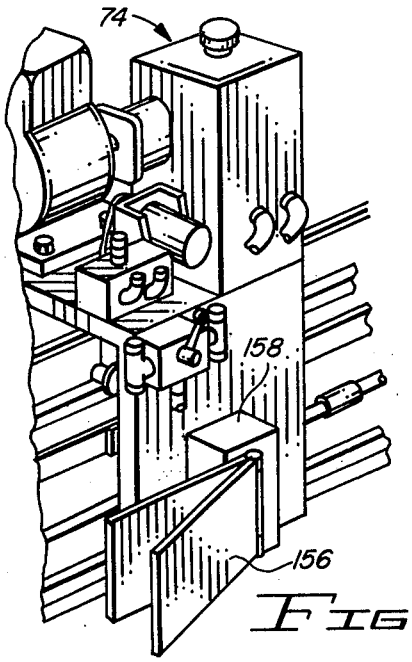
FIG. 18 is a partially cutaway perspective view depicting concrete spreading means of the present invention which includes only a "V"-shaped grading blade.
Figure 19:
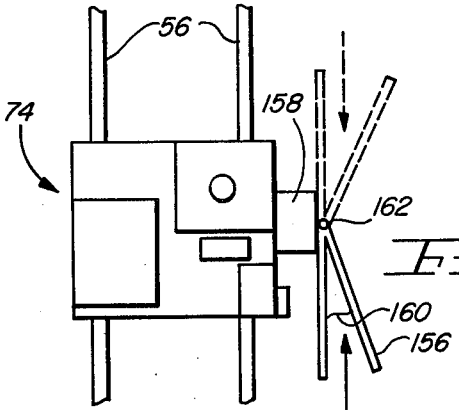
FIG. 19 is a simplified plan view of the present invention depicting concrete spreading means having a "V"-shaped grading blade, particularly illustrating the manner in which the grading blade is displaced between first and second positions as the direction of travel of the carriage changes.
Figure 20:
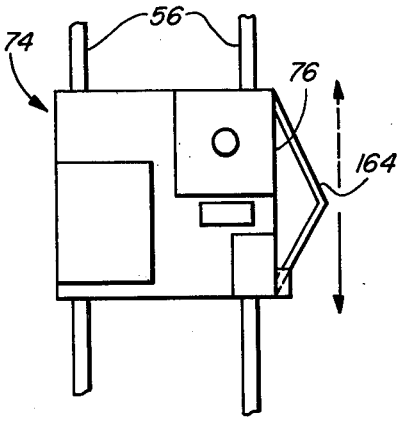
FIG. 20 is a simplified plan view of the present invention depicting a single fixed grading blade coupled to the front face of the carriage.

FIGS. 18, 19 and 20 depict mechanically simplified, less expensive versions of concrete spreading device 74. FIGS. 18 and 19 depict a configuration of the invention in which the rotating auger has been eliminated and a single, dual-face grading blade 156 is coupled by a hinge to bracket 158. In this simplified version of the present invention, the length of each grading blade is approximately eighteen inches. The angle between the two spaced apart grading blades designated by reference number 160 can be increased or decreased within a reasonable range. In the preferred embodiment of the invention, the angle designated by reference number 160 is on the order of twenty degrees. FIG. 19 depicts the manner in which grading blade 156 is deflected between first and second trailing positions with respect to hinge 162 as the direction of travel of concrete spreading device 74 is reversed.

FIG. 20 indicates yet another embodiment of the present invention in which a grading blade 164 comprises a dual-faced fixed position unit which is coupled directly to the fact of bracket 76.

The various different embodiments of the grading means of the present invention disclosed in FIGS. 18–20 and in the various other figures serve the purpose of partially illustrating the many different specific hardware configurations which fall within the scope of the term "grading means." Other different types of grading means which could be coupled to a concrete spreading device having a laterally translatable carriage means for translation back and forth across the length of a concrete screed would be immediately apparent to one of ordinary skill in the art.

Figure 12:
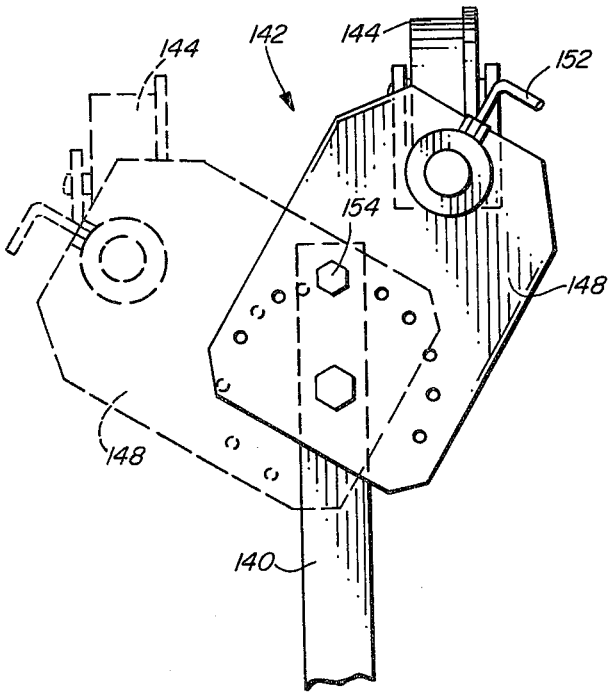
FIG. 12 is a plan view of the first and second units of the screed guide means.

Referring now to FIGS. 11 and 12, the screed guide means of the present invention will now be described in some detail. FIG. 11 illustrates that height adjustment means or jack 138 is coupled to one of the vertically oriented end members of end bracket 20. The lower end of jack 138 is coupled to a horizontally oriented roller bracket 140.

The height adjustment means described above is provided primarily for the purpose of elevating the front and rear screed blade assemblies 16 and 18 above the surface of the plastic concrete to permit the entire screed assembly to be readily translated back and forth across the concrete surface.

A separate laterally adjustable wheel unit 142 is coupled to each end of roller bracket 140. Various types of rollers 144 can be coupled to the screed guide means. In the embodiment illustrated in FIG. 11, a flanged roller 144 engages the interior edge of concrete from 146. Various different roller configurations (single flange, double flange, cupped roller, etc.) can readily be adapted to wheel unit 142 to properly interface with a form, an existing concrete edge or another screed support surface. A skid plate 147 is coupled to end bracket 20 and to front and rear screed blades 16 and 18. The flat lower surface of skid plate 147 extends the length of the screed frame and transfers the weight of the screed to form 146.

FIG. 12 best illustrates the manner in which wheel unit 142 permits roller 144 to engage a concrete form which may be positioned either inside, even with or outside of support bar 140. Since concrete screed 10 is generally fabricated from a plurality of screed sections having individual lengths of typically 2, 5 and 7½ feet, small lateral adjustments of the type provided by wheel unit 142 are important.

Each wheel unit 142 includes upper and lower, horizontally oriented pivot elements or pivot plates 148. The interior end of each pivot plate 148 includes an aperture through which a pivot pin extends to snugly couple that end of pivot plate 148 to roller bracket 140. The vertically oriented axle 150 of roller 144 can be held in a desired position by locking means such as a set screw 152 to properly align roller 144 with form 146. The lateral position of wheel unit 142 may be adjusted by removing bolt 154 and pivoting wheel unit 142 into the desired position. Bolt 154 is then inserted through one of the apertures which are positioned in an arc around wheel unit 142 to maintain roller 144 in a fixed lateral position.

Since a pair of wheel units 142 is coupled to each end of screed 10 and since approximately six to eight inches of lateral adjustment can be provided by each wheel unit, significant screed guide means width adjustments can be readily accomplished without having to disassemble the screed frame and either add or subtract frame sections to achieve the desired overall screed length. With very simple modifications, the screed guide means width adjustment feature discussed above could readily be modified to either provide greater or smaller amounts of lateral adjustment.

Figure 21:
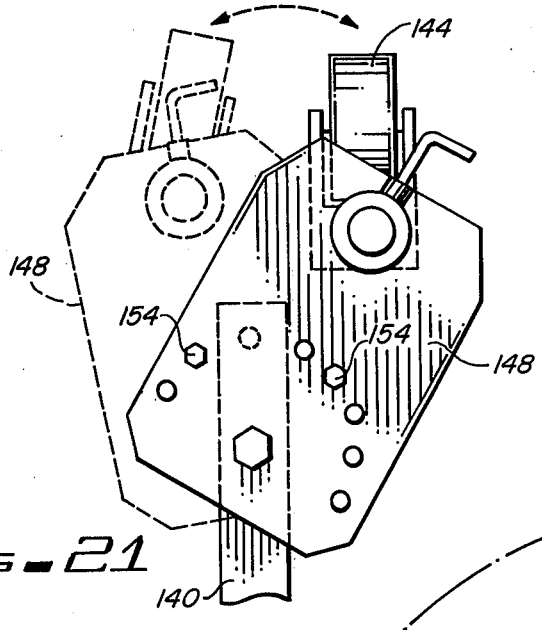
FIG. 21 depicts the manner in which a wheel unit of the screed guide means of the present invention can be configured to permit a range of movement to accommodate varying spacing between concrete forms.

FIG. 21 discloses a second configuration of the wheel unit of the present invention. In this configuration, a pair of bolts 154 are positioned through apertures in upper and lower pivot plates 148 lying outside of support bar 140. In this configuration, the wheel unit can freely pivot back and forth within a limited range determined by the position of bolts 154 to accomodate slight variations in the form spacing as the screed is advanced or rolled back along the forms.

Figure 22:
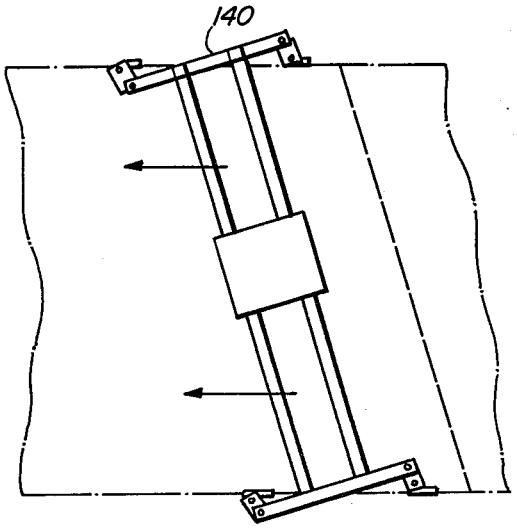
FIG. 22 illustrates the manner in which the screed guide means of the present invention can be configured to permit the screed to be skewed.

FIG. 22 indicates the manner in which the wheel units can be configured to permit the screed to operate in a skewed configuration with respect to the concrete forms. This skewed configuration is necessary when the boundaries between the freshly poured concrete and the preexisting road surface or other surface terminate or commence in a skewed configuration as frequently occurs when railroad tracks cross highways. FIG. 22 indicates that the wheel units which are coupled to support bar 140 on each end of the screed must be laterally displaced in opposite directions to permit the skewed configuration depicted.

Figure 23:
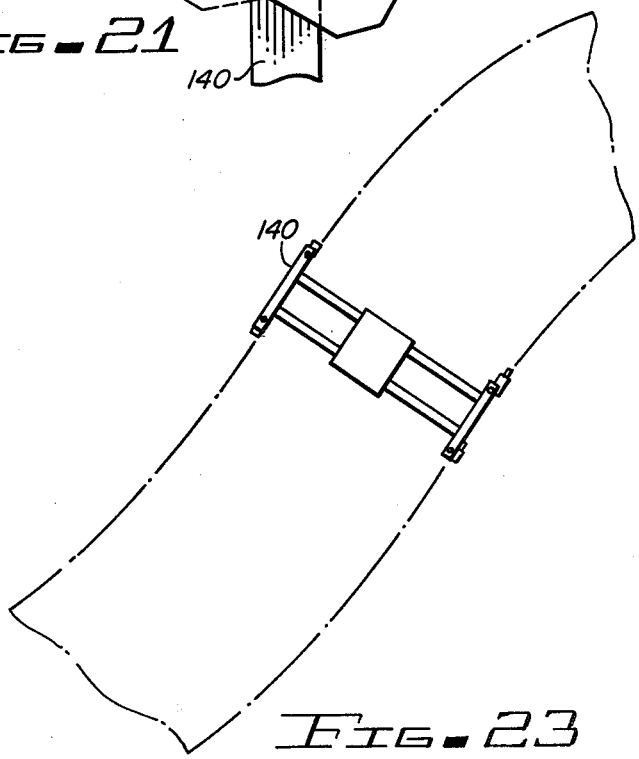
FIG. 23 is a simplified plan view of the present invention depicting the manner in which the screed guide means of the present invention permits the screed to travel along curved concrete forms.

FIG. 23 illustrates that the screed of the present invention including the screed guide means permits sufficient lateral displacement of the wheel units to enable the screed to track properly on curved forms.

Figures 24, 28:
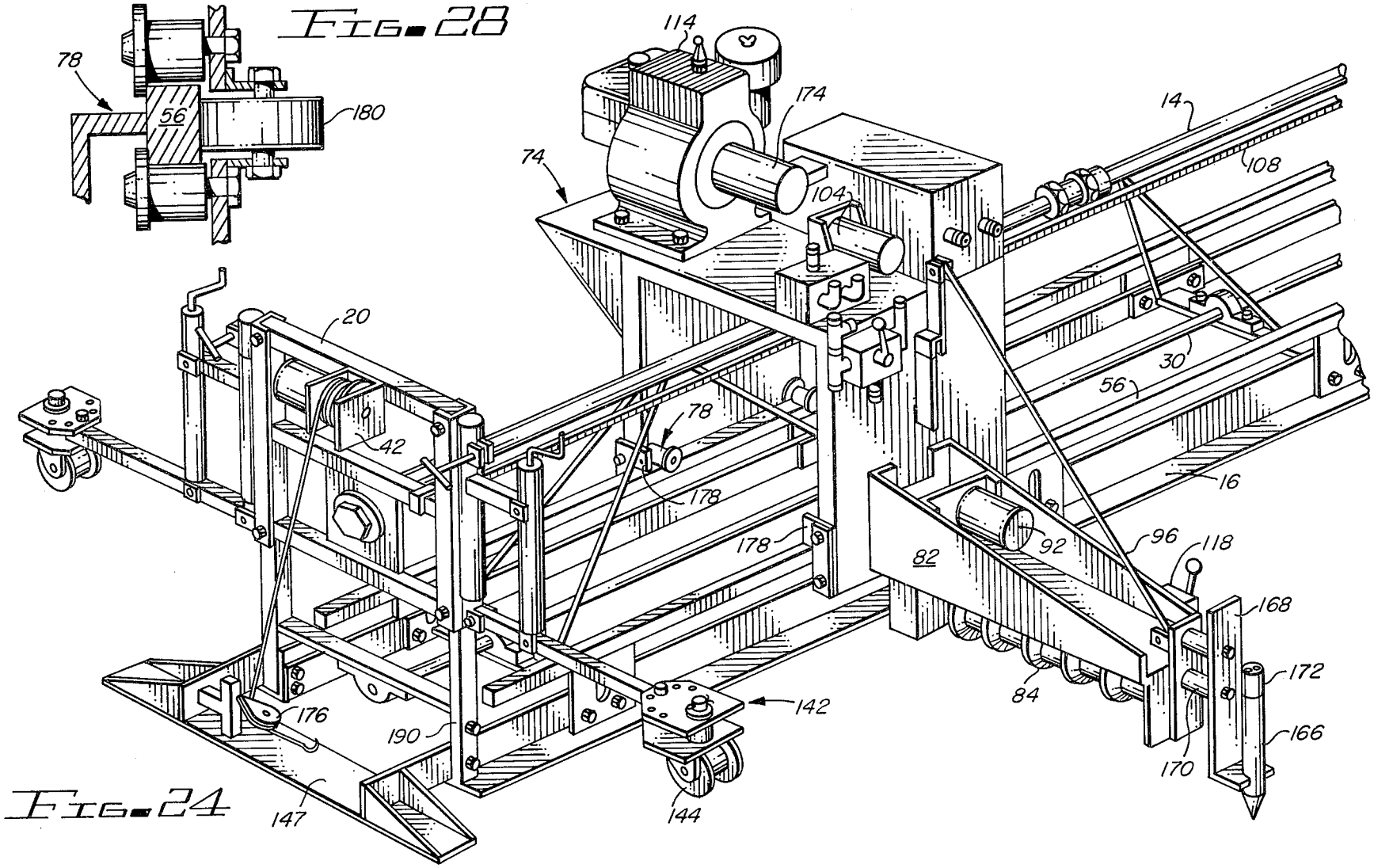
FIG. 24 is a partially cutaway perspective view of an alternative embodiment of a vibratory concrete screed including a modified concrete spreading device and a modified end support structure.
FIG. 28 is a partially cutaway sectional view of the modified roller assembly utilized on the screed depicted in FIG. 24.

Referring now to FIGS. 24–30, a modified version of the screed guide means and concrete spreading device is depicted. FIG. 24 illustrates that a vertically oriented vibrator 166 is coupled by a vertically oriented bracket and a pair of Lord vibratration isolation mounts 170 to the outer end section of auger support bracket 82. A hydraulic motor 172 is coupled to the upper section of vibrator assembly 166. The output shaft of motor 172 is coupled to rotate an eccentric weight disposed within the interior of vibrator 166. The pointed lower section of vibrator 166 penetrates the plastic concrete and imparts high frequency vibrations to the concrete for the purpose of further compacting the concrete prior to contact by auger blade 84. A pair of hydraulic lines (not shown) couple hydraulic motor 172 in parallel with auger motor 92 such that actuation of on/off valve 118 activates both auger motor 92 and vibrator motor 172.

In an alternative embodiment, vibrator 166 can be coupled to the pivoting deflector 98. Positioning vibrator 166 between the blades of deflector 98 has been found to be reasonably effective.

In the specific embodiment of the invention depicted in FIG. 24, engine 114 is coupled to drive a dual output or double hydraulic pump 174 in which each section of the pump produces a hydraulic fluid output flow on the order of four gallons per minute. One section of pump 174 powers auger motor 92 and vibrator motor 172 while the second section of pump 174 powers the carriage transport motor 104. The hydraulic circuit diagram depicted in FIG. 3 is modified in a manner well known to one of ordinary skill in the hydraulic arts to accomplish the objectives recited above in connection with the structure depicted in FIG. 24.

In the embodiment depicted in FIG. 24, a modified skid plate 147 includes front and rear sections which extend outboard of front and rear screed blades 16 and 18 to provide increased vertical stability to the screed. The winch 42 and the winch pulley 176 have been relocated as illustrated for the purpose of applying additional downward pressure to rear screed blade 18.

An "L"-shaped rubber wiper 178 is coupled by a bracket as depicted in FIG. 24 to the lower outboard edge of each corner of concrete spreading device 74. Rubber wiper 174 engages the upper and outer surfaces of horizontally oriented tracks 56 to displace splattered plastic concrete from tracks 56 and enables concrete spreading device 74 to travel smoothly back and forth across the vibrating screed.

Referring now to FIGS. 24, 28, 29 and 30, an improved version of roller assembly 78 is depicted. This embodiment includes a third, horizontally oriented roller 180 which is adjusted to snugly contact the exterior vertically oriented surface of track 56 at each of the four corners of concrete spreading device 74. FIGS. 29 and 30 depict the manner in which an eccentric adjustment device permits adjustment in the horizontal plane of the spacing between roller 180 and the vertically oriented side surfaces of concrete spreading device 74. A rotating adjustment member 182 includes an off-center cylindrical aperture. Rotation of member 182 causes the axle of roller 180 to be displaced either toward or away from track 56 to thereby adjust the pressure exerted by roller 180 on track 156.

Referring now to FIGS. 24, 25 and 26, a modified version of the screed guide means described above is depicted. In this embodiment, the screed guide means is divided into four independent sections or guide units which can each be independently adjusted in both the vertical and horizontal planes. This modified screed guide unit permits independent lateral adjustment of each roller 144 at each corner of the screed. In addition, the pressure exerted by each roller 144 on the supporting concrete form can be varied to control the vertical displacement of each of the four corners of the screed. The contact force between each end of each skid plate 147 can also be adjusted as desired. The independently adjustable screed guide means reduces or eliminated the tendency of the screed to tip forward into the plastic concrete and in addition assists in maintaining the desired contact angle between auger 84 and the plastic concrete surface.

Each independently controllable element of the improved screed guide means depicted in FIG. 24 includes a laterally pivoting hinge bracket 184. Each hinge bracket 184 includes a non-rotating upper element 186 and a non-rotating lower element 188. Hinge elements 186 and 188 are each rigidly secured to a channel member 189 which is bolted to the vertical support arm 190 of end bracket 20. A smaller diameter pipe (not clearly depicted) is concentrically disposed within the interior of hinge bracket 184 and upper and lower elements 186 and 188 and serves as a hinge pin. This hinge pin pipe is secured by a bolt which extends laterally through lower element 188 and completes the structure of hinge bracket 184. Pivoting hinge element 182 surrounds and pivots freely about the hinge pin.

A hinge lock assembly 192 includes a slot 194 in the upper surface of hinge element 182, a pair of laterally extending ears and a "T"-handle 198 having a threaded shaft. FIG. 27 illustrates that right hand ear 196 includes a threaded aperture while left hand ear 196 includes a non-threaded, larger diameter aperture. Two bolts are rigidly coupled as shown to the threaded section of "T"-handle 198. Clockwise rotation of "T"-handle 198 pulls right and left ears 196 together and clamps hinge element 182 to the non-rotating concentrically mounted pipe or hinge pin. In operation, hinge element 182 is adjusted to the desired lateral position and then is locked in that position by hinge lock assembly 192.

A support bar 200 is pivotally coupled at the interior end to hinge element 182. At an intermediate point, support bar 200 is pivotally coupled to the lower end of a telescopically extendable, vertically oriented jack assembly 202. The upper portion of jack assembly 202 is pivotally coupled to a horizontally oriented support strut 204. Rotation of handle 206 of jack 202 alternately either raises or lowers support bar 200 as depicted in FIG. 25. A locking device 208 can be actuated to secure handle 206 of jack 202 in a fixed position such that vibration of the screed does not cause undesired vertical adjustment of jack 202.

Each of the four independently controllable guide units of the improved screed guide means depicted in FIG. 24 is adjusted as described above to achieve optimum performance and operation of the concrete screed.

It will be apparent to those skilled in the art that the disclosed vibratory concrete screed may be modified in numerous ways and may assume many embodiments other than the preferred form specifically set out and described above. For example, it would be readily apparent that two separate, but identical concrete spreading devices could be coupled to a single screed frame and operated in a synchronized manner such that each separate concrete spreading device was translated back and forth over only one half the overall length of the screed. In this manner, a substantially greater area of concrete could be finished in a given time. In addition, numerous other different types of power or propulsion systems could be readily adapted to the present invention to achieve the desired results. For example, on the screed having an engine driven vibratory shaft, that same engine could power a hydraulic pump which could be coupled by overhead hydraulic lines to the concrete spreading device eliminating the hydraulic pump on that moving element of the present invention. Accordingly, it is intended by the appended claims to cover all such modifications of the invention which fall within the true spirit and scope of the invention.

I claim:

1. A vibratory concrete screed for finishing the irregular surface of an area of plastic concrete lying between first and second spaced apart, generally parallel forms, the spacing between the first and second forms defining the width of the plastic concrete, said screed comprising:

a. a triangular truss frame having first and second ends and a length equal to or greater than the width of the plastic concrete;

b. a screed blade coupled to said frame;

c. means coupled to said frame for translating said frame along the length of the plastic concrete;

d. means for vibrating said screed blade;

e. concrete spreading means coupled to said screed frame for leveling the surface of and evenly distributing plastic concrete in front of said screed blade, including:

i. grading means for contacting the surface of the concrete;

ii. carriage means for maintaining said grading means at a predetermined elevation in front of said screed blade and for translating said grading means in either a first or a second direction along said screed frame;

whereby the grading means levels the irregular surface of the plastic concrete and moves excess concrete forward and away from said screed blade as said carrige means translates said grading means in first and second directions along the length of said screed frame.

2. The screed of claim 1 wherein said grading means comprises a triangular shaped grading blade having a base coupled to said carriage means, an apex spaced apart from said carriage means and first and second grading surfaces.

3. The screed of claim 2 wherein said grading blade is configured as an isosceles triangle and wherein said first and second grading surfaces of said grading blade are inclined at an equal angle with respect to said screed blade.

4. The screed of claim 1 wherein said grading means further includes:

a. first and second grading surfaces and first and second end sections;

b. means for pivotally coupling the second end section of said grading means to said carriage means;

c. indexing means for maintaining a predetermined first angle between the first side of said grading means and said screed blade when said carriage means is translated in the first direction and for maintaining a predetermined second angle between the second grading surfaces and said screed blade when said carriage means is translated in the second direction.

5. The screed of claim 4 wherein the first and second angles maintained by said indexing means are equal.

6. The screed of claim 4 wherein translation of said carriage means in the first direction causes said grading means to pivot into a first trailing position wherein substantially all of said first grading surface is down stream of said pivot means and wherein translation of said carriage means in the second direction causes said grading means to pivot into a second trailing position wherein substantially all of said second grading surface is down stream of said pivot means.

7. The screed of claim 6 wherein said pivot means comprises a hinge for coupling the second end section of said grading means to said carriage means.

8. The screed of claim 7 wherein said grading means includes a "V"-shaped blade the apex of which is coupled by said hinge to said carriage means.

9. The screed of claim 8 wherein said pivot means includes a first stop for engaging said second grading surface of said grading means as said carriage means is translated in the first direction to maintain said first grading surface in the first trailing position and a second stop for engaging said first grading surface of said grading means as said carriage means is translated in the second direction for maintaining said second grading surface in the second trailing position.

10. The screed of claim 1 further including height adjustment means for controlling the elevation of said grading means with respect to said screed blade.

11. The screed of claim 10 wherein said height adjustment means further includes means for controlling the inclination of the lower surface of said grading means.

12. The screed of claim 11 wherein said inclination adjustment means comprises a turnbuckle assembly having a first end coupled to said carriage means and a second end coupled to said grading means.

13. The screed of claim 1 wherein said grading means further includes:

a. an auger coupled to said carriage means at a predetermined elevation with respect to said front screed blade; and b. auger drive means coupled to said carriage means for rotating said auger to laterally distribute plastic concrete and to displace plastic concrete away from said screed blade.

14. A vibratory concrete screed for finishing the irregular surface of an area of plastic concrete lying between first and second spaced apart, generally parallel forms, the spacing between the first and second forms defining the width of the plastic concrete, said screed comprising:

a. a frame having first and second ends and a length equal to or greater than the width of the plastic concrete;

b. a first screed blade coupled to said frame for engaging the full width of the plastic concrete;

c. means coupled to said frame for translating said frame along the length of the plastic concrete;

d. means for vibrating said first screed blade; and e. concrete spreading means coupled to said screed frame for leveling the surface of and evenly distributing plastic concrete in front of said first screed blade, including:

i. an auger;

ii. carriage means for maintaining said auger horizontally oriented in front of said frame at a predetermined elevation with respect to said first screed blade and for translating said auger back and forth along the length of said frame; and iii. auger drive means coupled to said carriage means for rotating said auger to distribute plastic concrete and to displace plastic concrete away from said first screed blade;

whereby forward translation of said screed along the length of the plastic concrete together with side to side translations of said carriage means along the length of said screed frame levels and finishes the surface of the plastic concrete.

15. The screed of claim 14 wherein said first screed blade includes a front screed blade and wherein said screed further includes a rear screed blade coupled to said frame and aligned to engage the plastic concrete at an elevation equal to the elevation of said front screed blade.

16. The screed of claim 15 further including a support track coupled to said frame at an elevation above said front and rear screed blades for translatably coupling said carriage means to said screed frame.

17. The screed of claim 16 wherein said carriage means further includes a roller assembly and wherein said roller assembly engages said support track.

18. The screed of claim 14 wherein said carriage means includes a self-contained hydraulic power system for translating said carriage means and for rotating said auger.

19. The screed of claim 18 wherein said self-contained hydraulic power system includes:

a. a hydraulic pump;

b. a first hydraulic motor for translating said carriage means back and forth across said screed frame; and c. a second hydraulic motor for rotating said auger.

20. The screed of claim 19 wherein said pump is driven by an internal combustion engine.

21. The screed of claim 19 further including valve means for controlling the speed and direction of rotation of said first hydraulic motor.

22. The screed of claim 14 wherein said vibrating means includes a plurality of pneumatic vibrators coupled at spaced apart intervals to said screed blade.

23. The screed of claim 14 wherein said vibrating means includes:

a. an eccentrically weighted shaft coupled at intervals to said screed frame and spanning substantially the entire of said screed; and b. means coupled to said screed for rotating said shaft.

24. The screed of claim 23 wherein said translating means includes:

a. a hydraulically powered winch;

b. a hydraulic pump coupled to and driven by said eccentrically weighted shaft.

25. The screed of claim 24 wherein said translating means further includes speed adjustment means for varying the speed of operation of said hydraulically powered winch.

26. The screed of claim 25 wherein said hydraulically powered winch is coupled to the first end of said screed and wherein said translation means further includes a second hydraulically powered winch coupled to the second end of said screed.

27. The screed of claim 26 wherein the speed of said first and said second hydraulically powered winches is independently controlled.

28. The screed of claim 15 wherein said carriage means includes an auger support bracket and wherein said auger includes first and second ends, said first end being coupled to said auger support bracket and located in proximity to said front screed blade and said second end being coupled to said auger support bracket and spaced apart from said front screed blade.

29. The screed of claim 28 further including a vibrator coupled to said auger support bracket and penetrating the plastic concrete surface to impart vibratory motion thereto.

30. The screed of claim 29 wherein said vibrator is hydraulically powered.

31. The screed of claim 14 further including an oscillating strike-off coupled to said screed between said auger and said screed blade at a predetermined elevation with respect to said screed blade for smoothing and compacting the plastic concrete before engagement of said concrete by said screed blade.

32. The screed of claim 31 further including means coupled to said screed and to said oscillating strike-off for reciprocating said strike-off in a horizontal plane.

33. A vibratory concrete screed for finishing the irregular surface of an area of plastic concrete lying between first and second spaced apart, generally parallel forms, the spacing between the first and second forms defining the width of the plastic concrete, said screed comprising:

a. a frame having first and second ends and a length equal to or greater than the width of the plastic concrete;

b. a screed blade coupled to said frame for engaging the full width of the plastic concrete;

c. means coupled to said frame for translating said frame along the length of the plastic concrete;

d. means for vibrating said screed blade;

e. concrete spreading means coupled to said screed frame for leveling the surface of and for evenly distributing plastic concrete in front of said screed, including:

i. an auger;

ii. carriage means for maintaining said auger horizontally oriented in front of said frame at a predetermined elevation with respect to said screed blade and for translating said auger back and forth along the length of said frame;

iii. grading means coupled to said carriage means and engaging the plastic concrete in front of said auger at a predetermined elevation for partially leveling the upper surface of the concrete and for distributing excess concrete forward and away from said auger; and iv. auger drive means coupled to said carriage means for rotating said auger to displace plastic concrete away from said screed blade;

Whereby forward translation of said screed along the length of the plastic concrete together with side to side translations of said carriage means along the length of said screed frame levels and finishes the surface of the plastic concrete.

34. The screed of claim 33 wherein said carriage means further includes height adjustment means for varying the elevation of said auger with respect to said screed blade.

35. The screed of claim 34 wherein said auger includes front and rear ends and wherein said height adjustment means varies the elevation of said grading means and the front end of said auger.

36. The screed of claim 33 further including an oscillating strike-off coupled to said screed between said auger and said screed blade at a predetermined elevation with respect to said screed blade for smoothing and compacting the plastic concrete before engagement of said concrete by said screed blade.

37. The screed of claim 36 further including means coupled to said screed and to said oscillating strike-off for reciprocating said strike-off in a horizontal plane.

38. The screed of claim 33 wherein said auger is oriented substantially perpendicular to said screed blade.

39. The screed of claim 33 wherein said carriage means further includes carriage drive means for translating said auger back and forth along the length of said frame.

40. The screed of claim 39 wherein said carriage drive means includes speed adjustment means for controlling the translation velocity of said carriage means.

41. The screed of claim 39 wherein said carriage drive means includes direction control means for reversing the direction of travel of said carriage means when said carriage means reaches a predetermined point along said screed frame.

42. The screed of claim 33 wherein said grading means includes first and second grading surfaces, wherein said first grading surface engages the irregular surface of the plastic concrete when said carriage means is translated along said screed in a first direction and wherein said second grading surface engages the irregular surface of plastic concrete when said carriage means is translated along said screed in a second direction.

43. The screed of claim 42 wherein said grading means is pivotally coupled to said carriage means.

44. The screed of claim 43 wherein said grading means includes a "V"-shaped plow.

45. The screed of claim 39 wherein said screed frame further includes a drive chain having first and second ends coupled in proximity to the first and second ends of said frame and wherein said carriage drive means engages said drive chain to translate said carriage means back and forth along the length of said frame.

46. A vibratory concrete screed for engaging the irregular surface of an area of plastic concrete lying between first and second spaced apart, generally parallel forms, the spacing between the first and second forms defining the width of the plastic concrete, said screed comprising:

a. a triangular truss frame having first and second ends and a length equal to or greater than the width of the plastic concrete;

b. a front screed blade coupled along the lower front edge of said frame and a rear screed blade coupled along the lower edge of said screed;

c. means coupled to said frame for translating said frame along the length of the plastic concrete;

d. means for vibrating said front and rear screed blades;

e. screed guide means including a first guide unit coupled to the first end of said screed and a second guide unit coupled to the second end of said screed for coupling said screed to the forms, each of said first and second units comprising:

i. a roller support bracket having a front end section extending beyond said front screed blade and a rear end section extending beyond said rear screed blade;

ii. screed height adjustment means coupled to said roller support bracket and to the adjacent end of said screed for vertically displacing said roller support bracket with respect to said screed frame;

iii. first and second wheel units coupled to the front and rear end sections of said roller support bracket, each of said wheel units including:

A. a pivot element having inboard and outboard sections, said inboard section being pivotally coupled to said roller support bracket to enable said pivot element to be angularly displaced in the horizontal plane with respect to said roller support bracket;

B. roller support means rotatably coupled to the lower outboard section of said pivot element;

C. a roller coupled to said roller support means below said pivot element;

D. means coupled to said pivot element for locking said element in a fixed angular position with respect to said roller support bracket to thereby align with roller above the adjacent form.

47. The screed of claim 46 further including secondary locking means coupled to said pivot element for locking said roller support means in a fixed angular position.

48. The screed of claim 46 wherein said screed height adjustment means includes a vertically oriented jack.

49. The screed of claim 46 wherein said pivot element includes:

a. an upper pivot plate contacting the upper surface of said roller support bracket;

b. a lower pivot plate contacting the lower surface of said roller support bracket; and c. means for coupling said upper and lower pivot plates to said roller support bracket.

50. The screed of claim 49 wherein said roller support means includes a vertically oriented shaft having an upper section rotatably coupled to said upper and lower pivot plates and a lower section coupled to said roller.

51. The screed of claim 46 further including a skid plate coupled to the first end of said screed, said skid plate including a flat, horizontally oriented lower surface extending outward beyond the first end of said screed for extending the effective length of said screed and for engaging the first form.

52. The screed of claim 46 wherein said screed height adjustment means is capable of vertically displacing said roller support bracket between an extended position in which said screed is elevated above the concrete surface and a retracted position in which said screed contacts the concrete surface, whereby when said screed height adjustment means is in the extended position, said front and rear screed blades are elevated above the surface of the concrete and said wheel units engage said forms to permit said screed to be rolled back over the finished concrete without disturbing the surface of the concrete.

* * * * *